US006996993B2

(12) United States Patent
Crowley

(10) Patent No.: US 6,996,993 B2
(45) Date of Patent: Feb. 14, 2006

(54) PULSE TUBE REFRIGERATOR SYSTEM

(75) Inventor: David Michael Crowley, Marlow Bottom (GB)

(73) Assignee: Oxford Magnet Technology Ltd., Oxford (GB)

( * ) Notice: Subject to any disclaimer, the term of this patent is extended or adjusted under 35 U.S.C. 154(b) by 0 days.

(21) Appl. No.: 10/640,681

(22) Filed: Aug. 14, 2003

(65) Prior Publication Data

US 2004/0107705 A1 Jun. 10, 2004

(30) Foreign Application Priority Data

Aug. 17, 2002 (GB) ..... 0219207
Apr. 24, 2003 (GB) ..... 0309296

(51) Int. Cl.
*F25B 9/00* (2006.01)

(52) U.S. Cl. ..... 62/6

(58) Field of Classification Search ..... 62/6, 62/298

See application file for complete search history.

(56) References Cited

U.S. PATENT DOCUMENTS 2,193,540 A * 3/1940 Schulse ..... 62/164
5,335,505 A * 8/1994 Ohtani et al. ..... 62/6
5,341,654 A * 8/1994 Hewette et al. ..... 62/296
5,515,685 A 5/1996 Yanai et al.
5,647,219 A 7/1997 Rattray et al.
5,735,127 A * 4/1998 Pfotenhauer et al. ..... 62/6
5,782,095 A 7/1998 Chen
6,021,643 A 2/2000 Swift et al.
6,082,117 A * 7/2000 Funatsu et al. ..... 62/6
6,351,954 B1 * 3/2002 Nogawa et al. ..... 62/6
6,378,312 B1 4/2002 Wang
6,434,947 B2 * 8/2002 Zhu et al. ..... 62/6

FOREIGN PATENT DOCUMENTS

JP 63-217608 9/1988
JP 2002-61508 A 2/2002

OTHER PUBLICATIONS

British Examination Report dated Apr. 6, 2005.

* cited by examiner

*Primary Examiner*—William C. Doerrler
(74) *Attorney, Agent, or Firm*—Crowell & Moring LLP

(57) ABSTRACT

A pulse tube refrigerator system comprises a pulse tube refrigerator and a compressor coupled together via a high pressure line and a low pressure line. Cryogenic fluid is transferred to the PTR via the high pressure line and returned to the compressor via the low pressure line. The system further comprises an acoustic tuning device coupled to the low pressure line between a low pressure output from the PTr and a lower pressure input to the compressor, such that noise and vibration in the PTR system are reduced.

22 Claims, 2 Drawing Sheets

PULSE TUBE REFRIGERATOR SYSTEM

BACKGROUND OF THE INVENTION

This invention relates to a pulse tube refrigerator (PTR) system that includes an arrangement for suppressing noise and vibrations.

Refrigeration systems used with magnetic resonance imaging (MRI) and other medical applications work by expanding high pressure helium gas, supplied from a compressor through a first gas transfer line to a regenerator device where the gas expands. This expanded gas now at lower pressure and higher velocity than the supplied high pressure gas, is returned to the compressor through a second gas transfer line. To operate at the required temperatures and pressures, these lines tend to be made of corrugated stainless steel. The increased velocity of the returning gas passing through the line leads to noise and vibration in the cooling system. Generally, in medical applications, the PTR and three quarters of the gas transfer line is installed in the examination room which for MRI is an RF cabin and also an anechoic chamber, as a result of which the impact of the noise is negligible, so no steps are taken to reduce noise and vibration caused by the return flow. However, as future applications for PTR's are developed where there would not otherwise be a requirement for an anechoic room, then this could significantly increase the expense of installing the system and it may require more space than is practical for the user to provide.

SUMMARY OF THE INVENTION

In accordance with the present invention, a pulse tube refrigerator system comprises a pulse tube refrigerator (PTR) and a compressor coupled together via a high pressure line and a low pressure line, wherein cryogenic fluid is transferred to the PTR via the high pressure line and returned to the compressor via the low pressure line; the system further comprising an acoustic tuning device coupled to the low pressure line between a low pressure output from the PTR and a low pressure input to the compressor, such that noise and vibration in the PTR system are reduced.

The provision of an acoustic tuning device coupled to the low pressure line between a low pressure output from the PTR and a low pressure input to the compressor enables the noise and vibration produced by the returning gas to be reduced, so improving the working conditions of the user. Over time, PTR's can be expected to replace GM coolers in any of their applications, so this problem will become more significant.

There are various possible embodiments of the acoustic tuning device. In one embodiment the acoustic tuning device comprises a dead end volume.

This enables the effect of pulsed gas flows to be smoothed out in the return line.

Alternatively, the acoustic tuning device comprises providing a low pressure line having a greater diameter than the diameter of the high pressure line.

The larger diameter tubing has the advantage of further reducing the velocity of the gas flow, and so the associated noise and vibration.

Preferably, the low pressure line comprises flexible corrugated stainless steel tubing.

The high pressure line is generally also made of corrugated stainless steel, although an alternative is to use a rigid tube with a flexible coupling on the ends to connect to the PTR and compressor.

Conventionally, gas lines for PTR applications have a diameter of ¾", so to achieve the improvements in performance preferably, the tubing has a diameter in the range greater than ¾ inch (1.905 cm) to 6 inch (15.24 cm).

Typically, the pressure difference between the high pressure and low pressure is of the order of 12 bar. The nominal pressures for supplying helium are a high pressure of 20 bar and a low of 8 bar, although these may vary a little with temperature.

The size of the dead end volume depends upon the extent to which the peak pulse exceeds the average flow, but preferably, the dead end volume is up to 10 litres.

The choice of cryogenic fluid is dependent upon the temperature of operation of the PTR. For low temperatures, around 4K, typically, the cryogenic fluid is helium.

DETAILED DESCRIPTION OF THE INVENTION

In a standard helium cooled PTR system operating down to 4K, the gas is supplied at 20 bar and returns to the compressor at 8 bar. The reduction in pressure means that the flow rate must increase correspondingly to be able to transfer the same volume of gas out. To cope with the temperature and pressure of operation the gas is generally supplied via corrugated flexible stainless steel tubing, but gas flowing at high speed over these corrugations whistles with a characteristic noise. To minimise the aggravation that this would cause, it is necessary to reduce the rate of gas flow close to the outlet valve.

Figure 1:
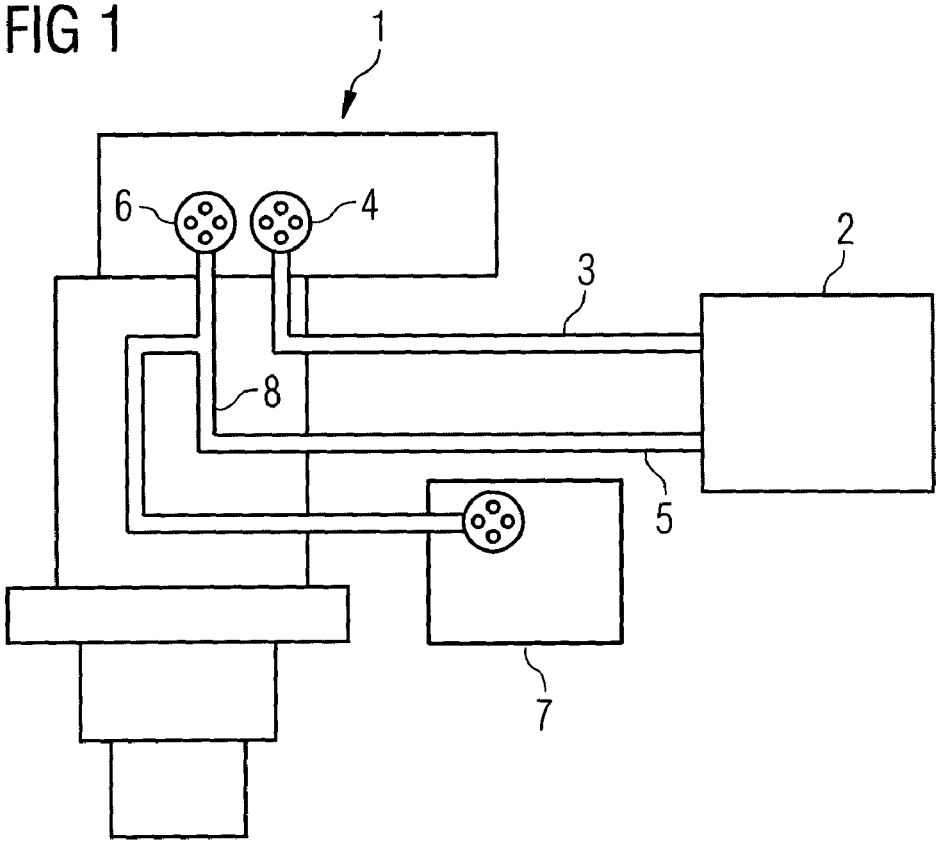
FIG. 1 illustrates a first embodiment of a system according to the present invention;.

FIG. 1 illustrates a pulse tube refrigerator system provided with an acoustic tuning device in accordance with a first embodiment of the present invention. The system comprises a PTR 1 and a compressor 2. A high pressure gas transfer line 3 provides helium gas to the PTR from the compressor via a high pressure coupling 4 and a low pressure gas transfer line 5 returns the gas from the PTR 1 to the compressor 2 via a low pressure coupling 6. For MRI applications, these lines are typically 20 m long and made from corrugated stainless steel tubing. At the low pressure, the velocity of the gas increases relative to that at the high pressure, leading to noise and vibration in the cooling system as the gas flows over the corrugations in the tubing, so a dead end volume 7 is coupled via a tee joint 8 to the low pressure line 5 close to the low pressure outlet. The effect of the dead end volume 7 is that gas at the low pressure outlet is diverted to the dead end volume, to relieve the pressure on the return line 5. The dead end volume is typically between 7.5 and 10 litres.

Figure 2:
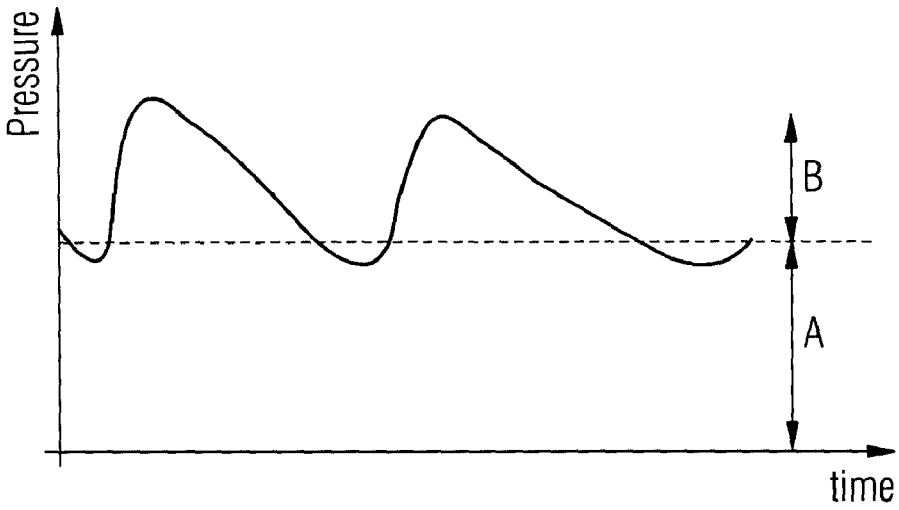
FIG. 2 illustrates operation of the system of FIG. 1.

Fluid flow in the PTR is pulsed, which has the effect that the gas which has expanded through the system and reaches the low pressure outlet, initially will have a higher pressure than gas reaching the low pressure outlet somewhat later in the cycle as shown in FIG. 2. A basic pressure A applies at all times in the cycle, but there are peaks indicated by B, which increase the noise and vibration of the fluid flow in the return line 5. This invention smoothes out these peaks. The initial pulse of gas is split between the low pressure line 5 and the dead end volume 7, then as the pressure and associated gas flow falls back during the cycle, the gas stored in the dead end volume will flow out of it back to the compressor.

Figure 3:
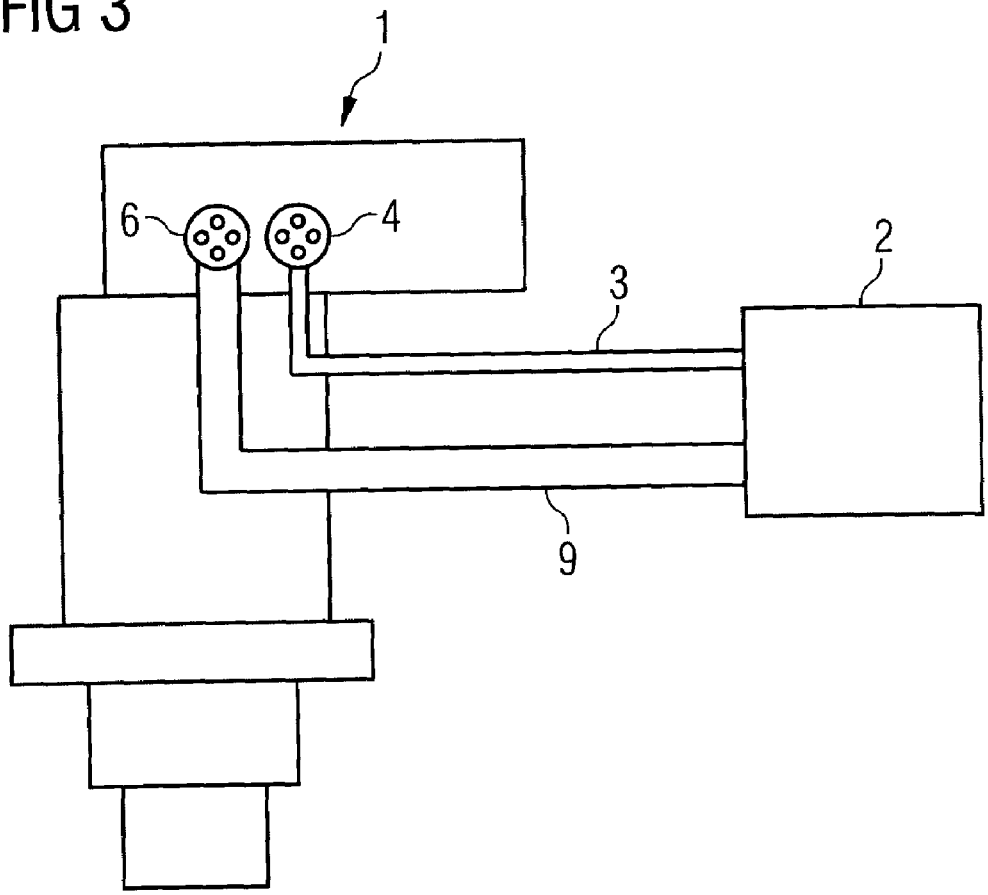
FIG. 3 illustrates a second embodiment of a system according to the present invention.

In an alternative embodiment, shown in FIG. 3, the noise and vibration associated with the low pressure line is reduced by making the low pressure line 9 in a wider bore than that of the high pressure line. There is a requirement to move a greater volume of gas from the low pressure outlet to the compressor, than the volume put in via the high pressure inlet because of the pressure difference. This causes an increase in flow rate to be able to pass the same volume in the same time and hence an increase in noise due to the flow over the corrugations of the low pressure line. Providing a wider bore for the low pressure flow than the high pressure one, solves this problem.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A pulse tube refrigerator system, comprising:

a pulse tube refrigerator;

a compressor;

high and low pressure lines coupling said pulse tube refrigerator and said compressor, cryogenic fluid being transferred to the pulse tube refrigerator via the high pressure line and returned to the compressor via the low pressure line; and an acoustic tuning device coupled in direct fluid flow communication to the low pressure line between a low pressure output from the pulse tube refrigerator and a low pressure input to the compressor, whereby noise and vibration in the pulse tube refrigerator system are reduced;

wherein the acoustic tuning device comprises a dead end volume.

2. The system according to claim 1, wherein the dead end volume is within a range from approximately 7.5 liters to approximately ten liters.

3. A pulse tube refrigerator system, comprising:

a pulse tube refrigerator;

a compressor;

high and low pressure lines coupling said pulse tube refrigerator and said compressor, cryogen gas being transferred to the pulse tube refrigerator via the high pressure line and returned to the compressor via the low pressure line; and an acoustic tuning device coupled to the low pressure line between a low pressure output from the pulse tube refrigerator and a low pressure input to the compressor, whereby noise and vibration in the pulse tube refrigerator system are reduced;

wherein the acoustic tuning device comprises a low pressure line having a diameter greater than that of the high pressure line.

4. The system according to claim 1, wherein the low pressure line comprises flexible stainless steel tubing.

5. The system according to claim 1, wherein the low pressure line has a diameter within a range from approximately ¾ inch to 6 inches.

6. The system according to claim 1, wherein the high pressure line and low pressure line have a pressure difference between them of the order of 12 bar.

7. The system according to claim 1, wherein the cryogenic fluid is helium.

8. A refrigerator system comprising:

a compressor;

a pulse tube refrigerator;

a high pressure line connected between a high pressure output of said compressor and a high pressure input of the pulse tube refrigerator;

a low pressure line which is separate from said high pressure line, and connects a low pressure output of the pulse tube refrigerator and a low pressure input to the compressor, said high and low pressure lines transferring a cryogenic gas between the pulse tube refrigerator and the compressor; and an acoustic tuning device connected to said low pressure line between said low pressure output of the pulse tube refrigerator and said low pressure input to said compressor;

wherein the acoustic tuning device comprises a dead end volume.

9. The system according to claim 8, wherein the dead end volume is within a range from approximately 7.5 liters to approximately ten liters.

10. A refrigerator system comprising:

a compressor;

a pulse tube refrigerator;

a high pressure line connected between a high pressure output of said compressor and a high pressure input of the pulse tube refrigerator;

a low pressure line which is separate from said high pressure line, and connects a low pressure output of the pulse tube refrigerator and a low pressure input to the compressor, said high and low pressure lines transferring a cryogenic gas between the pulse tube refrigerator and the compressor; and an acoustic tuning device connected to said low pressure line between said low pressure output of the pulse tube refrigerator and said low pressure input to said compressor;

wherein the acoustic tuning device comprises a low pressure line having a diameter greater than that of the high pressure line.

11. The system according to claim 8, wherein the low pressure line comprises flexible stainless steel tubing.

12. The system according to claim 8, wherein the low pressure line has a diameter within a range from approximately ¾ inch to 6 inches.

13. The system according to claim 8, wherein the high pressure line and low pressure line have a pressure difference between them of the order of 12 bar.

14. The system according to claim 8, wherein the cryogenic fluid is helium.

15. The system according to claim 3, wherein the low pressure line comprises flexible stainless steel tubing.

16. The system according to claim 3, wherein the low pressure line has a diameter within a range from approximately ¾ inch to 6 inches.

17. The system according to claim 3, wherein the high pressure line and low pressure line have a pressure difference between them of the order of 12 bar.

18. The system according to claim 3, wherein the cryogenic fluid is helium.

19. The system according to claim 10, wherein the low pressure line comprises flexible stainless steel tubing.

20. The system according to claim 10, wherein the low pressure line has a diameter within a range from approximately ¾ inch to 6 inches.

21. The system according to claim 10, wherein the high pressure line and low pressure line have a pressure difference between them of the order of 12 bar.

22. The system according to claim 10, wherein the cryogenic fluid is helium.

* * * * *